US005791465A

United States Patent [19]

Niki et al.

[11] Patent Number: 5,791,465

[45] Date of Patent: Aug. 11, 1998

[54] MOIST WIPE PACKAGE

[75] Inventors: Yoshifumi Niki; Hirofumi Nakanishi; Yuji Watahiki; Yutaka Saito, all of Tochigi-ken, Japan

[73] Assignee: Kao Corporation, Tokyo, Japan

[21] Appl. No.: 792,757

[22] Filed: Feb. 4, 1997

[30] Foreign Application Priority Data

Feb. 15, 1996 [JP] Japan ..... 8-028117

[51] Int. Cl.[6] ..... B65D 81/24

[52] U.S. Cl. ..... 206/210; 206/494; 383/104

[58] Field of Search ..... 206/210, 233, 206/494; 383/104, 121, 123, 124, 125, 907; 53/469, 479; 493/243, 255, 260, 261

[56] References Cited

U.S. PATENT DOCUMENTS

| | | | |
|---|---|---|---|
| 2,087,934 | 7/1937 | Anderson | 383/125 |
| 2,152,323 | 3/1939 | Moore | 493/255 |
| 2,267,320 | 12/1941 | Berch | 53/479 |
| 2,406,678 | 8/1946 | Gerahty | 53/479 |
| 2,574,345 | 11/1951 | Montgomery | 206/494 |
| 2,678,768 | 5/1954 | Vergobbi | 383/121 |
| 3,089,298 | 5/1963 | Neuendorf et al. | 53/479 |
| 3,126,796 | 3/1964 | Vergobbi | 493/243 |
| 3,743,172 | 7/1973 | Ackley et al. | 383/104 |
| 4,616,470 | 10/1986 | Nakamura . | |
| 4,714,454 | 12/1987 | Herrington | 493/225 |
| 4,764,030 | 8/1988 | Humphrey | 383/121 |
| 4,848,575 | 7/1989 | Nakamura et al. | 206/494 |
| 5,195,829 | 3/1993 | Watkins et al. | 383/104 |
| 5,524,759 | 6/1996 | Herzberg et al. | 206/494 |
| 5,582,294 | 12/1996 | Yamada | 206/494 |

FOREIGN PATENT DOCUMENTS

| | | |
|---|---|---|
| 0503314A1 | 9/1992 | European Pat. Off. . |
| 1200787 | 8/1970 | United Kingdom . |
| WO 90/09933A1 | 2/1990 | WIPO . |

*Primary Examiner*—David T. Fidei

*Attorney, Agent, or Firm*—Birch, Stewart, Kolasch & Birch, LLP

[57] ABSTRACT

A moist wipe package 1 comprising moist wipes 11 and a storing body 12 for storing the moist wipes 11 therein, the storing body 12 having a generally rectangular parallelepiped body formed from a generally square sleeve-like packing material whose opposite ends are open, an outlet opening 13 through which said moist wipes 11 are withdrawn being formed in one surface 12*a* of the packing material, opposite side edge portions 12*a'*, 12*a'* of one surface 12*a* and/or opposite side edge portions 12*b'*, 12*b'* of the other surface 12*b* opposing the one surface 12*a* being enhanced in rigidity so that they may have self-supporting properties, and the one surface 12*a* and the other surface 12*b* being sealed at the opposite ends, the sealed opposite ends 12*d*, 12*d* being fixed so that the one surface 12*a* forms opposing two end faces 12*e* in the generally rectangular parallelepiped body.

7 Claims, 2 Drawing Sheets

MOIST WIPE PACKAGE

BACKGROUND OF THE INVENTION

1. [Field of the Invention]

The present invention relates to a moist wipe package comprising moist wipes and a storing body for storing the moist wipes therein, and more particularly to a moist wipe package wherein stack-up storage can be made, an opening- and closing-cover label can easily be attached and detached, moist wipes can easily be withdrawn therefrom, and manufacture can be made at a low cost.

2. [Description of Related Art]

Heretofore, a moist wipe package having a storing body containing moist wipes impregnated with a sterilizing agent or a cosmetic material, is well known. FIG. 3 depicts one example of such a conventional moist wipe package. The moist wipe package 100 comprises moist wipes 111 and a storing body 112 in which the moist wipes is stored. The storing body 112 is provided with an outlet opening 113 through which the moist wipes can be withdrawn. The outlet opening 113 is covered with an opening- and closing-cover label 114 detachably (peelably) attached to the storing body 112.

The storing body 112 is formed by sealing opposite open ends of a sleeve-like packing material. The packing material is made of a soft film for ease of carrying and other reasons. The use of a soft film material as the packing material tends to result in a lack in shape retention of the storing body 112. For this reason, the conventional moist wipe package 100 has such problems that stacking-up storage of several moist wipe packages is difficult; that the moist wipe packages thus stacked tend to collapse, that the opening- and closing-cover label 114 is difficult to attach to and detach from the storing body 112, and that the moist wipes 111 are difficult to be withdrawn from the storing body 112, and so forth.

In order to enhance the shape retention, there is known a proposed technique as discussed in Japanese Utility Model Publication No. 37329/1985, in which a plate made of synthetic resin material or the like is interposed between a top surface of a storing body and the moist wipes therein. However, this conventional technique requires the extra processes of manufacturing the plate and interposing it between the top surface of the storing body and the moist wipes. In addition, disposal after use renders another problem.

SUMMARY OF THE INVENTION

It is, therefore, an object of the present invention to provide a moist wipe package, wherein stack-up storage can be made, an opening- and closing-cover label can easily be attached and detached, and moist wipes can easily be withdrawn therefrom.

The present invention has achieved the above object by providing a moist wipe package comprising moist wipes and a storing body in which the moist wipes are stored, the storing body being provided with an outlet opening through which the moist wipes are withdrawn, the outlet opening being covered with an opening- and closing-cover label detachably attached to the storing body, the storing body having a generally rectangular parallelepiped body formed from a generally square sleeve-like packing material whose opposite ends are open, an outlet opening through which the moist wipes are withdrawn being formed in one surface of the packing material, opposite side edge portions of said one surface and/or side edge portions of the other surface opposite said one surface being rigidly enhanced so that they may have self-supporting properties, and the one and the other surface being sealed at open opposite ends, the sealed opposite ends being fixed so that the one surface forms opposing two end faces in the generally rectangular parallelepiped body.

According to the moist wipe package of the present invention, stack-up storage can be made, the opening- and closing-cover label can easily be attached and detached, the moist wipes can easily be withdrawn, and the moist wipe package can be manufactured at a low cost.

DETAILED DESCRIPTION OF THE INVENTION

One embodiment of a moist wipe package according to the present invention will now be described specifically with reference to the accompanying drawings. It should be noted that the moist wipe package described below is a package of moist wipes for cleansing the hips of infants embodied according to the present invention.

Figure 1:
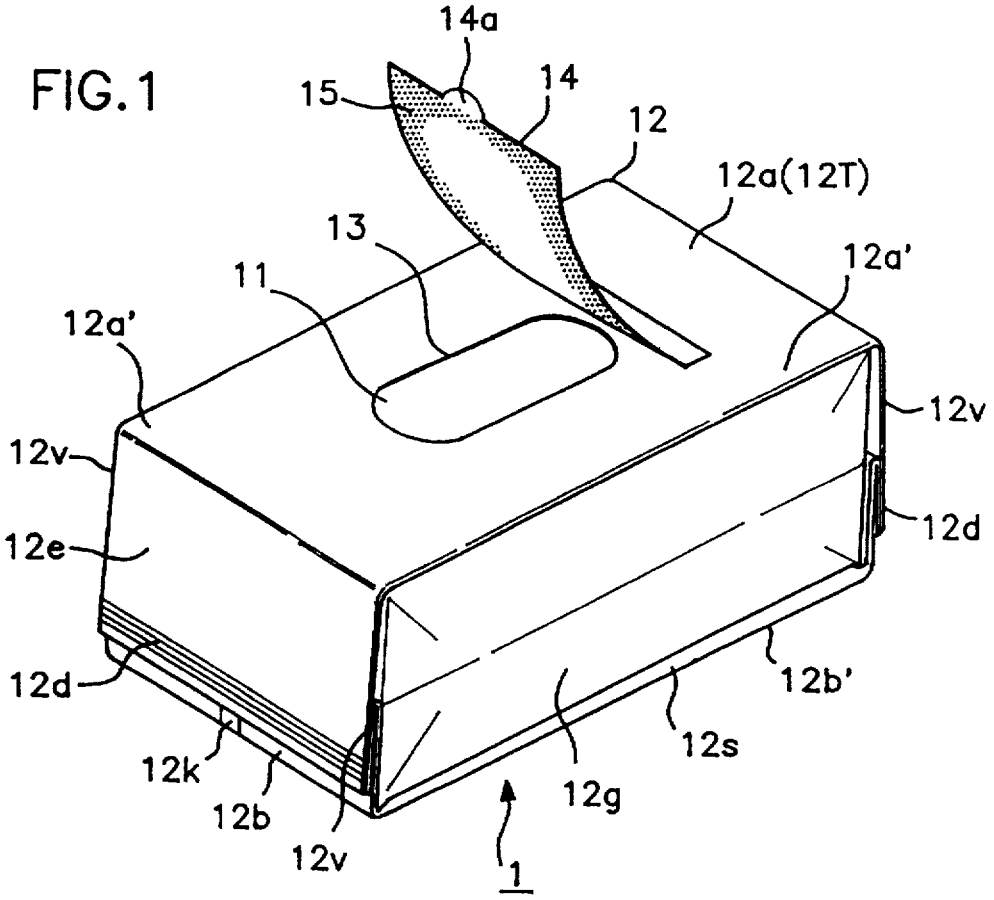
FIG. 1 is a perspective view showing a moist wipe package according to one embodiment of the prevention.

FIG. 1 is a perspective view showing a moist wipe package according to one embodiment of the present invention.

As shown in FIG. 1, the moist wipe package 1 comprises moist wipes 11 and a storing body 12 in which the moist wipes 11 are stored. The storing body 12 is provided with an outlet opening 13 through which the moist wipes 11 are withdrawn. The outlet opening 13 is covered with an opening- and closing-cover label 14 detachably (peelably) attached to the storing body 12. This construction is the same as the conventionally known technique.

In the moist wipe package 1 according to this embodiment, the storing body 12 has a generally rectangular parallelepiped body formed from a generally square sleeve-like packing material whose opposite ends are open. The outlet opening 13 is formed in surface **12*a* of the packing material. Opposing side edge portions 12*a*', 12*a*' of surface 12*a*, and opposing side edge portions 12*b*', 12*b*' (only one is shown) of the other surface 12*b* opposite surface 12*a* are rigidly enhanced so that they exhibit self-supporting properties. The surfaces 12*a* and 12*b* are sealed at the open opposite ends. The both sealed opposite ends 12*d*, and 12*d* are fixed so that the one surface 12*a* forms two opposing end faces 12*e*, 12*e*** (only one is shown) in the generally rectangular parallelepiped body.

The term "self-supporting properties" described herein refers to that, when the one and the other surfaces are sealed at the opposite ends, and the sealed opposite ends are fixed so that the one surface forms opposing two end faces in the generally rectangular parallelepiped body, the generally rectangular parallelepiped body has shape retention property to the extent that a plurality of the storing bodies can be stacked.

This embodiment will now be described in detail. The packing material is produced by forming a sleeve-like body into a generally square sleeve-like configuration, a sleeve-like body being formed by overlapping and adhering inner surfaces of longitudinal opposite side edge portions of a single sheet-like member. Opposing side edge portions 12a', 12a' of surface 12a and the opposing side edge portions 12b', 12b' (only one is shown) of the opposite surface 12b are rigidly enhanced by hem sealing. Hem sealing refers to a process to bond the opposing side edge portions 12a', 12a' of surface 12a or the opposing side edge portions 12b', 12b' of surface 12b to the side surfaces 12g, 12g (only one is shown) adjacent to the surface 12a or 12b such that their respective inner surfaces are connected thereby forming one integrated body. The formation of one integrated body is carried out by means of pressure bonding, adhering with an adhesive, melt-bonding or the like. The sheet-like member is from 20 μm to 120 μm in thickness. The material of the sheet-like member may be polyethylene terephthalate, aluminum, or crystalline polypropylene or the like.

The opposing side edge portions 12a', 12a' of surface 12a and the opposing side edge portions 12b', 12b' (only one is shown) of surface 12b are hem sealed at a width of from 2 to 7 mm, preferably from 3 to 5 mm with their adjacent side surfaces 12g, 12g (only one is shown), so that they are rigidly enhanced. The hem sealed portion 12S is located on an extension of surface 12a or surface 12b. The overlapped portion 12k formed by overlapping and adhering the inner surfaces of the sheet-like member is disposed on the center of the other surface 12b.

The rigidity of the opposing side edge portions 12a', 12a' of the one surface 12a and the opposing side edge portions 12b', 12b' (only one is shown) of surface 12b is preferably from 0.0025 $Kg/cm^2$ or more in order to obtain appropriate self-supporting properties and 0.04 $Kg/cm^2$ or less in light of the texture of the product.

The rigidity referred to herein is defined as the added weight per unit area ($Kg/cm^2$) which is required, when a square sleeve-like packing material has been formed into a generally rectangular parallelepiped body, needed to buckle the hollow generally rectangular parallelepiped body (in the non-storing state of the moist wipes) with the addition of weight over the entire top surface of the body from above.

This rigidity can be determined specifically in such a manner where 78×84 cm and 78 g of an acrylic plate is placed on a rectangular body formed from a square sleeve-like packing material, and weight is added over the acrylic plate from above by a weight measuring machine (CPU GUAGE 9500 Series, manufactured by AIKOH ENGINEERING CO., LTD) thereby determining the minimum value of the weight V which buckle the rectangular body, and then calculation is made by the following equation:

$R=V/S$ ($R$: rigidity, $V$: minimum value of added weight, $S$: area of the top surface)

The open opposite ends of the packing material are sealed by the same technique as in the case with the opposite ends of the conventional moist wipe package. The sealed opposite ends 12d, 12d are folded with surface 12b located inside, and the mutually opposing other surfaces are fixed by hot melt adhesive, thereby forming the generally rectangular parallelepiped body.

The outlet opening 13 is formed by opening up a central area of surface 12a into an elliptical configuration. This outlet opening 13 is positioned in a top surface 12T of the storing body 12.

The opening- and closing-cover label 14 has a generally rectangular configuration with a tongue-like handle portion 14a provided on one end thereof. A pressure sensitive adhesive 15 is applied to a peripheral edge of one surface of the cover label 14. This cover label 14 is adhered to the storing body 12 through the pressure sensitive adhesive 15, so that the label can repeatedly be attached and detached with respect to the storing body 12.

The moist wipes 11 are composed of pulp non-woven fabric which is impregnated with a sterilizing agent. The moist wipes 11 are stacked in an interleaved array and stored in the storing body 12 so that they can be withdrawn in a pop-up manner.

In the moist wipe package 1 thus constructed according to this embodiment, opposing side edge portions 12a', 12a' of the top surface 12T and opposing side edge portions 12b', 12b' on a bottom surface (not shown) opposite the top surface 12T of the storing body 12 are rigidly enhanced. Similarly, opposite orthogonal side edge portions 12v, 12v, 12v, 12v (only three are shown) of opposite end faces 12e, 12e (only one is shown) of the storing body 12 also consist of side edge portions 12a', 12a' which are rigidly enhanced. Accordingly, favorable shape retention of the storing body 12 is ensured.

Thus, according to the moist wipe package 1 of this embodiment, a stack of a plurality of the moist wipe packages 1 is difficult to collapse, and stack-up storage can easily be made. Furthermore, the outlet opening 13 can be opened and closed by easily attaching and detaching the opening- and closing-label cover 14 with respect to the storing body 12. Moreover, the moist wipes 11 can easily be withdrawn from the storing body 12.

According to the moist wipe package 1 of this embodiment, since no extra members are used for the purpose of enhancing the shape retention, the manufacturing of the moist wipe package costs little.

The present invention should not be limited to the above embodiment. It can be appropriately modified without departing from the gist of the invention.

For example, a sheet-like member, a tube film, or the like may be formed into a generally square configuration and used as the packing material.

It is not absolutely necessary that the opposing side edge portions 12a', 12a' of the one surface 12a and the opposing side edge portions 12b', 12b' (only one is shown) of the other surface 12b are all rigidly enhanced. Only the opposing side edge portions 12a', 12a' of surface 12a or only the opposing side edge portions 12b', 12b' (only one is shown) of the other surface 12b can be rigidly enhanced. In the event only the opposing side edge portions 12a', 12a' of surface 12a or only the opposing side edge portions 12b', 12b' (only one is shown) of surface 12b is rigidly enhanced, it is preferred that the opposite side edge portions 12a', 12a' of surface 12a are rigidly enhanced. The reason is that the opposite orthogonal side edge portions 12v, 12v, 12v, 12v (only three are shown) of the opposite end faces 12e, 12e (only one is shown) are rigidly enhanced over the entire length thereof and therefore, the stack-up storage can be enhanced.

It suffices that the opposing side edge portions 12a', 12a', 12b', 12b' (only three are shown) of the packing material are rigidly enhanced to the extent capable of ensuring the self-supporting properties. The technique for enhancing the rigidity is not limited to hem sealing.

The hem sealing is not necessarily applied at a width of from 2 to 7 mm. The hem sealing is applied preferably at a width of from 2 to 7 mm and more preferably at a width of from 3 to 5 mm. The hem sealing applied at a width of smaller than 2 mm will meet technical difficulties. The hem sealing applied at a width of larger than 7 mm costs too much and the effects corresponding to the increased cost are difficult to obtain.

The sealed opposite ends 12*d*, 12*d* may be fixed by suitable means other than hot melt adhesive.

Edges of the generally square sleeve-like packing material are not necessarily 90 degrees, and may be rounded.

Figure 2:
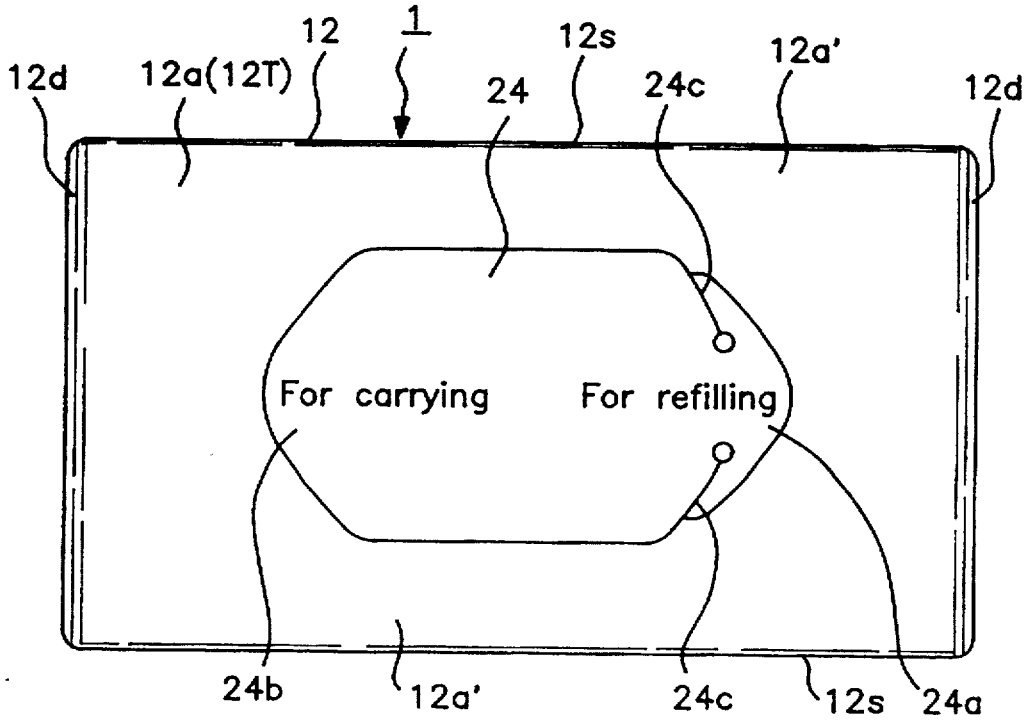
FIG. 2 is a plane view of a moist wipe package according to another embodiment of the present invention.
Figure 3:
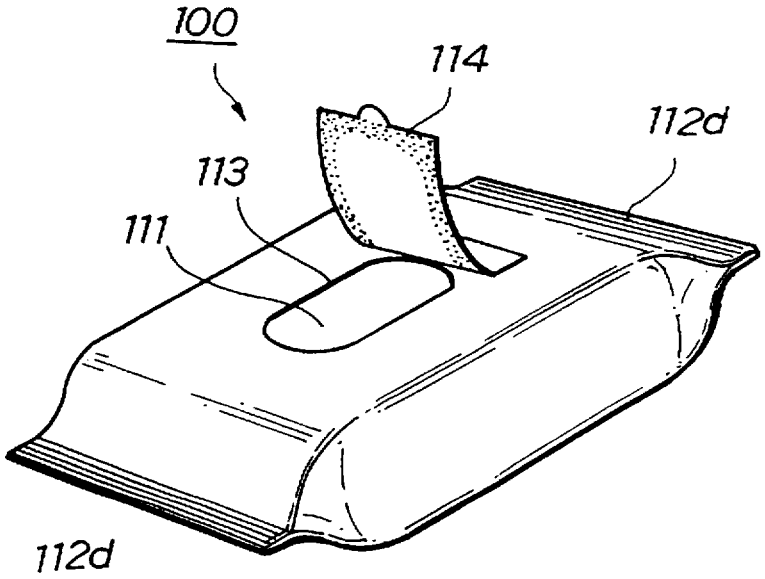
Fig. 3 PRIOR ART
FIG. 3 is a perspective view showing a conventional moist wipe package.

The opening- and closing-cover label may also be constructed as shown in FIG. 2. This opening- and closing-cover label 24 is provided at one end portion thereof with one handle portion 24*a* and at the other end portion thereof with another handle portion 24*b*. This label 24 is also provided with a cut portion 24*c* extending from opposite side edges in the vicinity of the first-mentioned end portion (namely, one end portion) towards the one end portion. When the label 24 is detached from the one handle portion 24*a*, the entire label 24 is detached. On the other hand, when the label 24 is detached from the handle portion 24*b*, the detaching motion is interrupted by the cut portion 24*c* and therefore, the label 24 can repeatedly be attached and detached. The indication "For refilling" is shown on the handle portion 24*a* and the indication "For carrying" is shown on the handle portion 24*b*, so that it is easy to discriminate between handle portion 24*a* for entirely detaching the label and the handle portion 24*b* for repeatedly attaching and detaching from storing body 12.

The moist wipes package according to the present invention may be used as packages other than as packages for moist wipes impregnated with a sterilizing agent for the purpose of wipes for wiping infants as in the moist wipe package 1 of the above embodiments such as packages being for moist wipes impregnated with a detergent or a germicide, or for moist wipes impregnated with a cosmetic material, and so forth.

The invention being thus described, it is obvious that the same can be modified without departing from the spirit and scope of the present invention.

What is claimed is:

1. A moist wipe package comprising moist wipes and a storing body in which said moist wipes are stored, said storing body being provided with an outlet opening through which said moist wipes are withdrawn, said outlet opening being covered with an opening- and closing-cover label detachably attached to said storing body, said storing body having a generally rectangular parallelepiped body formed from a generally square sleeve shaped packing material having open opposite ends, said outlet opening being formed in one surface of said packing material, opposing side edge portions of said one surface and/or opposing side edge portions of a surface opposite said one surface being made rigid so that they exhibit self-supporting properties, and said one and said opposite surface being sealed together at the open opposite ends to form sealed opposite ends, the sealed opposite ends being fixed so that said one surface and said opposite surface form opposing two end faces of said generally rectangular parallelepiped body.

2. A moist wipe package as defined in claim 1, wherein said packing material is obtained by forming a sleeve shaped body into a generally square sleeve shaped configuration, said sleeve-like body being formed by overlapping and adhering inner surfaces of longitudinal opposite side edge portions of a single sheet-like member.

3. A moist wipe package as defined in claim 1 or 2, wherein the rigidity of said opposing side edge portions of said one surface is from 0.0025 $Kg/cm^2$ to 0.04 $Kg/cm^2$.

4. A moist wipe package as defined in claim 1, wherein the opposing side edge portions of said one surface and/or the opposing side edge portions of said other surface are made rigid by hem sealing.

5. A moist wipe package as defined in claim 2, wherein the opposing side edge portions of said one surface and/or the opposing side edge portions of said other surface are made rigid by hem sealing.

6. A moist wipe package as defined in claim 3, wherein the opposing side edge portions of said one surface and/or the opposing side edge portions of said other surface are made rigid by hem sealing.

7. The moist wipe package according to claim 1, wherein said opposite surface is folded back on itself at said sealed opposite ends to form opposing two end faces.

* * * * *